US005996627A

United States Patent [19]

Reynolds

[11] Patent Number: 5,996,627

[45] Date of Patent: Dec. 7, 1999

[54] ADJUSTABLE FLUID VALVE FOR DIAPHRAGM PUMPS

[75] Inventor: Steven M. Reynolds, Lucas, Ohio

[73] Assignee: Warren Rupp, Inc., Mansfield, Ohio

[21] Appl. No.: 09/173,595

[22] Filed: Oct. 15, 1998

[51] Int. Cl.[6] ..... F15B 13/02

[52] U.S. Cl. ..... 137/625.6; 137/625.69

[58] Field of Search ..... 137/625.6, 625.69

[56] References Cited

U.S. PATENT DOCUMENTS

| | | | |
|---|---|---|---|
| 2,767,689 | 10/1956 | Moog | 137/625.62 |
| 2,920,650 | 1/1960 | Moog | 137/625.69 |
| 3,385,166 | 5/1968 | Kroffke | 137/625.6 X |
| 3,418,002 | 12/1968 | Hennells | 137/625.69 X |
| 3,799,200 | 3/1974 | Tipton | 137/625.6 |
| 4,085,655 | 4/1978 | Olson | 91/307 |
| 4,377,183 | 3/1983 | Johansson et al. | 137/884 X |
| 4,509,556 | 4/1985 | Scanlon | 137/884 |
| 4,770,209 | 9/1988 | Neff | 137/884 |

*Primary Examiner*—Gerald A. Michalsky
*Attorney, Agent, or Firm*—Hill & Simpson

[57] ABSTRACT

A fluid diaphragm pump is provided with a means for controlling the flowrate of fluid to the main fluid valve. Specifically, in the main fluid valve, a sleeve accommodates a sliding spool. The sleeve may include control orifices disposed at either end of the sleeve for controlling the flowrate of fluid past the spool to the outlet of the main fluid valve. The pilot valve housing may also include removable inserts for regulating the flow of fluid to the inlet side of the main fluid valve which results in a restriction of the flowrate of fluid to the main fluid valve. In both embodiments, the flowrate can be changed by either changing one or more components of the sleeve to increase or decrease the diameter of the control orifices or by removing the inserts in the pilot valve housing to either increase or decrease the diameter of the control orifices defined in by the inserts.

11 Claims, 5 Drawing Sheets

ADJUSTABLE FLUID VALVE FOR DIAPHRAGM PUMPS

FIELD OF THE INVENTION

The present invention relates generally to pumps and, more specifically, to fluid powered diaphragm pumps. Still more specifically, the present invention relates to a means for adjusting or tuning the efficiency of a fluid powered diaphragm pump by controlling the fluid flow to the main fluid valve of the pump.

BACKGROUND OF THE INVENTION

The efficiency of a fluid powered diaphragm pump is defined as a comparison of the ratio of the input fluid volume over the fluid inlet pressure consumed by the pump with the ratio of the output fluid volume over the system head generated by the pump. The efficiencies of currently-available pumps vary depending upon the operating parameters and operating conditions. While the input fluid pressure is a parameter that can be easily controlled, the input fluid volume is typically fixed and depends upon the design of the pilot valve assembly and the main fluid valve or main air valve assembly. In the event it is desired to adjust the input fluid volume to the main fluid valve, the pump would need to be disassembled and modifications would need to be made to the main valve and/or the pilot valve. Of course, this procedure is entirely too costly and time consuming to be implemented in practice.

Therefore, there is a need for an improved fluid powered diaphragm pump design whereby the flowrate or input flow volume to the main fluid valve can be adjusted without substantially disassembling the pump and/or replacing the main fluid valve.

SUMMARY OF THE INVENTION

The present invention satisfies the aforenoted needs by providing a fluid powered diaphragm pump equipped with a main fluid valve assembly that comprises a spool slidably accommodated in a housing. The spool is movable between a first position and a second position. The housing comprises a first inlet, a second inlet and an outlet. The spool comprises a first peripheral or circumferential channel that provides communication between the first inlet and the outlet when the spool is in the first position. The spool further comprises a second peripheral or circumferential channel that provides communication between the second inlet and the outlet when the spool is in the second position. The main fluid valve assembly further comprises a first control orifice disposed between the first inlet and the outlet for controlling the fluid flow between the first inlet and the outlet. The main fluid valve assembly also comprises a second control orifice disposed between the second inlet and the outlet for controlling the fluid flow between the second inlet and the outlet. The first and second control orifices are detachably connected to the main fluid valve assembly.

In an embodiment, the spool of the main fluid valve assembly of the present invention is accommodated in a first sleeve portion and a second sleeve portion. The first and second control orifices are disposed in the first and second sleeve portions respectively.

In an embodiment, the spool is slidably accommodated in a first sleeve portion which is disposed over the first peripheral channel and the first control orifice is disposed in the first sleeve portion. Further, the spool is slidably accommodated in a second sleeve portion which is disposed over the second peripheral channel and the second control orifice is disposed in the second sleeve portion.

In an embodiment, the first and second sleeve portions are separate from one another and are detachably connected to opposing ends of the cavity of the housing which accommodates the spool.

In an embodiment, the first and second sleeve portions are detachably connected to the housing with pins.

In an embodiment, the first and second sleeve portions are detachably connected to the housing with threaded fasteners.

In an embodiment, the housing is detachably connected to a first sleeve and a second sleeve. The first sleeve slidably accommodates the spool when the spool is in the first position and the first control orifice is disposed in the first sleeve. The housing further is detachably connected to a second sleeve which slidably accommodates the spool when the spool is in the second position and the second control orifice is disposed in the second sleeve.

In an embodiment, the diaphragm pump of the present invention further comprises a pilot valve assembly disposed between the first and second inlets and the outlet. The first and second control orifices are disposed in the pilot valve assembly.

In an embodiment, the pump of the present invention further comprises a pilot valve housing disposed between the first and second inlets and the outlet. The first and second control orifices are disposed in the pilot valve housing.

In an embodiment, the present invention comprises a kit for modifying a rate of fluid flow through a main fluid valve of a fluid powered diaphragm pump. The main fluid valve includes a spool disposed in a housing. The spool comprises a first channel for providing communication between a first inlet and an outlet and the spool comprises a second channel for providing communication between a second inlet and the outlet. The kit comprises at least one sleeve for accommodating the spool. The sleeve comprises a first control orifice disposed between the first inlet and the outlet and a second control orifice disposed between the second inlet and the outlet. The sleeve is detachably connected to one of the spool or the housing.

In an embodiment, the sleeve further comprises a first sleeve portion and a second sleeve portion. The first and second control orifices are disposed in the first and second sleeve portions respectively.

In an embodiment, the first and second sleeve portions are separate from one another and are detachably connected to opposing ends of the housing cavity that accommodates the spool.

In an embodiment, the first and second sleeve portions are detachably connected to the housing with pins.

In another embodiment, the first and second sleeve portions are detachably connected to the housing with threaded fasteners.

In an embodiment, the present invention provides a kit for modifying a rate of fluid flow through a main fluid valve of a fluid powered diaphragm pump. The main fluid valve includes a spool disposed in a housing. The spool comprises a first channel for providing communication between a first inlet and an outlet and the spool comprises a second channel for providing communication between a second inlet and an outlet. The pump further comprises a pilot valve housing disposed between both the first and second inlets and the spool. The pilot valve housing comprises a first aperture disposed between the first inlet and the spool and a second aperture disposed between the second inlet and the spool.

The first and second apertures accommodating any one of a plurality of sized inserts. The sized inserts defining sized orifices between the first and second inlets and the spool for controlling the flowrate between the first and second inlets and the spool.

In an embodiment, the present invention provides a method for controlling a flowrate through a main fluid valve of a fluid powered diaphragm pump. The main fluid valve includes a spool disposed in a housing. The spool comprises a first channel for providing communication between a first inlet and an outlet and the spool comprises a second channel for providing communication between a second inlet and the outlet. The method comprises the steps of providing at least one removable sleeve in the housing which comprises a first control orifice and a second control orifice, attaching the sleeve to the housing and inserting the spool in the sleeve so the first control orifice is disposed over the first groove of the spool and the second control orifice is disposed over the second groove of the spool.

It is therefore an advantage of the present invention to provide an improved fluid powered diaphragm pump whereby the fluid flowrate to the main fluid valve assembly may be controlled by either reducing the fluid flowrate or increasing the fluid flowrate after the manufacture of the pump and without a substantial disassembly of the pump.

Yet another advantage of the present invention is that it provides a kit for changing the flowrate to the main fluid valve of a fluid powered diaphragm pump to fine tune the efficiency thereof.

Still another advantage of the present invention is that it provides an improved means for changing the flowrate to the main fluid valve of a fluid powered diaphragm pump and thereby fine tuning the efficiency thereof.

Yet another advantage of the present invention is that it provides an improved fluid powered diaphragm pump having an efficiency that can be easily adjusted.

Other objects and advantages of the present invention will become apparent to those skilled in the art upon reviewing the following detailed description, drawings and appended claims.

BRIEF DESCRIPTION OF THE DRAWINGS

For a more complete understanding of the present invention, reference should now be made to the embodiments illustrated in greater detail in the accompanying drawings and described below by way of an example of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
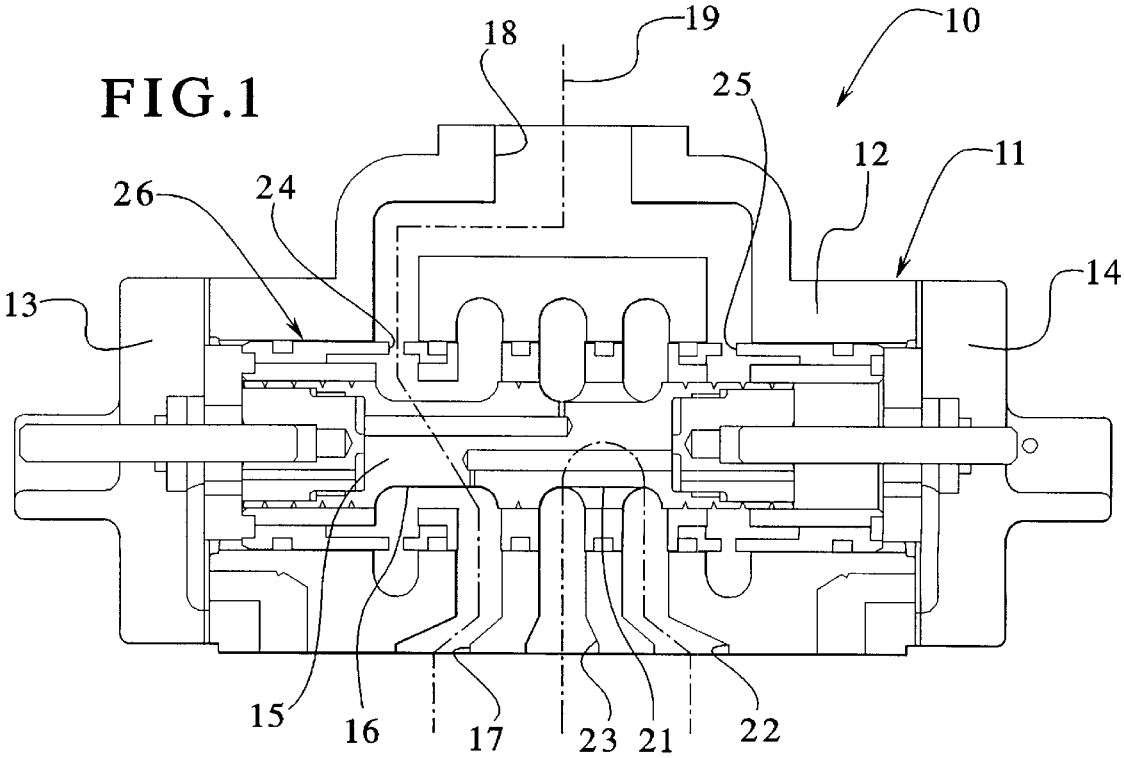
FIG. 1 is a schematic sectional view of a main fluid valve of a fluid powered diaphragm pump made in accordance with the present invention.

The general operation of fluid powered diaphragm pumps is known in the art and need not be described in detail here. In FIG. 1, a sectional view of a main fluid valve assembly 10 is provided which includes a housing 11 with a manifold component 12 and two end plates 13, 14. The housing 11 defines a central cavity for slidably accommodating a spool 15. The spool 15 slides back and forth between the position as shown at the left in FIG. 1 (or a first position) and towards the right (or a second position which is not shown). The spool 15 includes two peripheral channels, including a first channel 16 that establishes communication between an inlet (not shown) or an inlet passageway 17 and the outlet 18 as shown by the line 19. When the spool 15 is shifted to the right, or to a second position, a second peripheral channel 21 will establish communication between the inlet (not shown) and the outlet 18 by way of the inlet passageway 22. However, when the spool 15 is in the first or left position, the channel 21 provides communication between the inlet passageway 22 and the central return passageway 23.

While the first and second peripheral channels 16, 21 of the spool 15 provide communication between the inlet passageways 17, 22 and the outlet 18, control orifices are provided at 24, 25 for controlling the flow of fluid through the channels 16, 21 to the outlet 18. In the embodiment illustrated in FIG. 1, the control orifices are disposed within a sleeve 26 disposed within the housing 11. The spool 15 slides back and forth within the sleeve 26.

Figure 4:
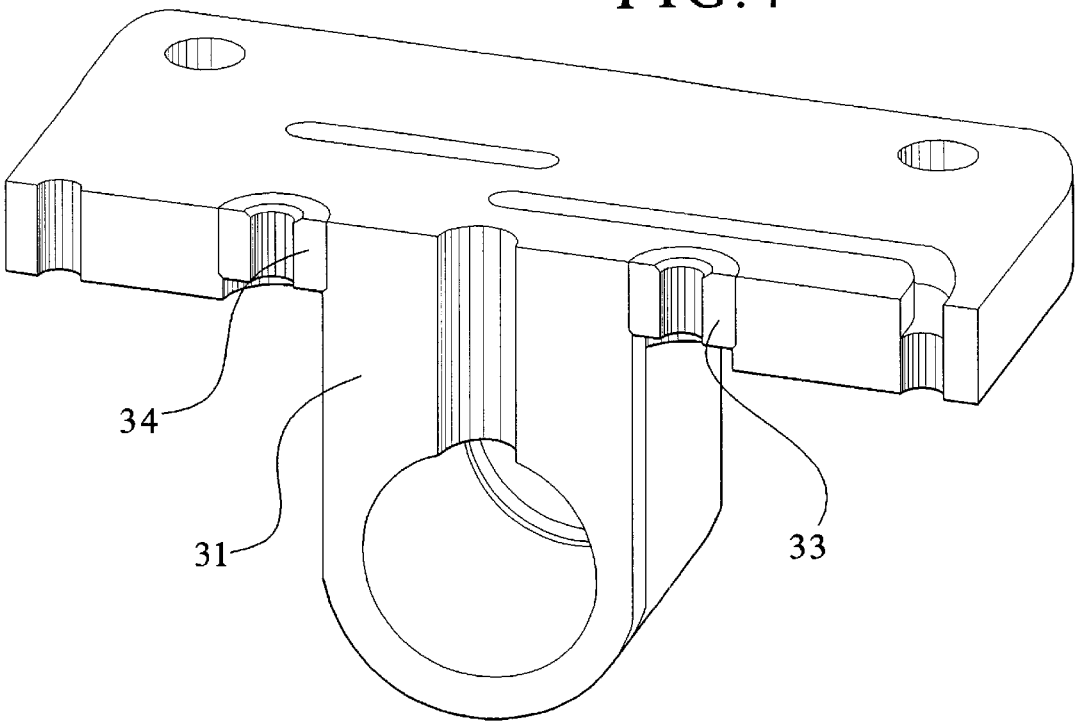
FIG. 4 is a perspective sectional view of a pilot valve housing made in accordance with the present invention.
Figure 2:
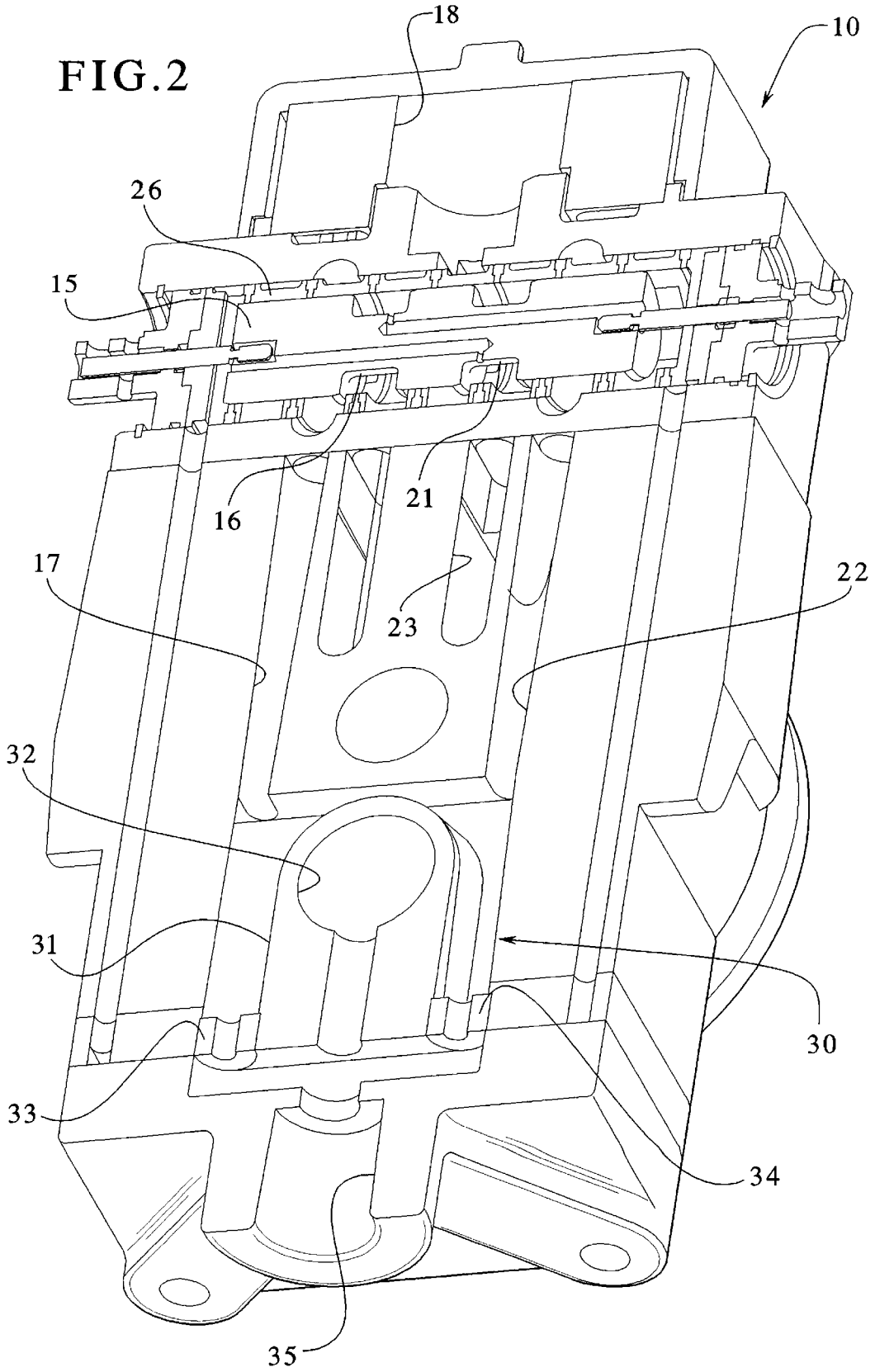
FIG. 2 is a perspective sectional view of a combination main fluid valve assembly and pilot valve assembly made in accordance with the present invention.
Figure 3:
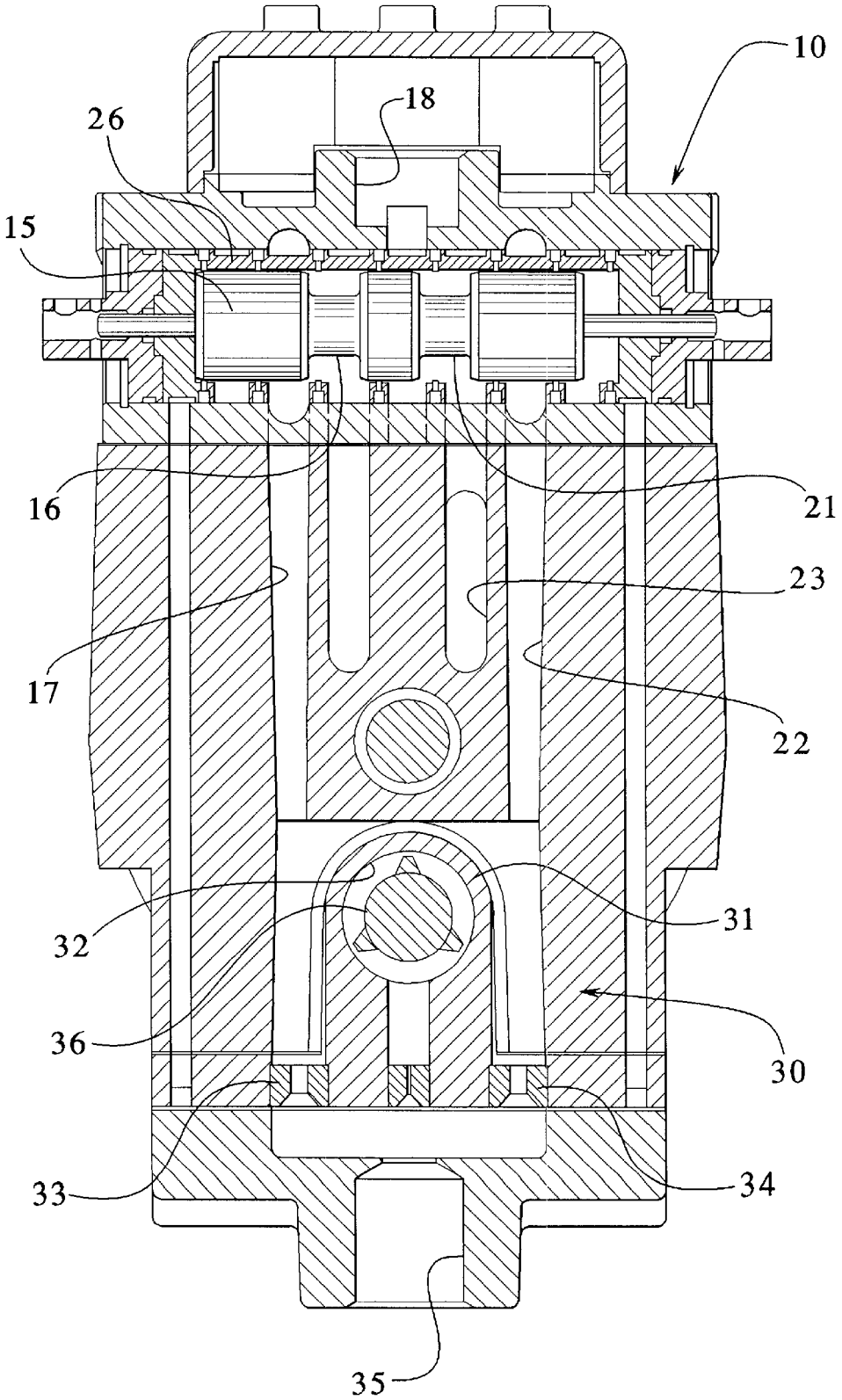
FIG. 3 is another sectional view of the combination main fluid valve assembly and pilot valve assembly shown in FIG. 2.

Turning to FIG. 2, the main fluid valve assembly 10 is shown disposed above a pilot valve assembly 30 which includes a pilot valve housing 31 which accommodates a pilot valve (not shown) in a central cavity 32. The pilot valve housing 31 is equipped with two inserts 33, 34 which are disposed in the inlet passageways 17, 22 and between the inlet 35 and the main fluid valve assembly 10. Thus, instead of or in addition to control orifices disposed in the sleeve 26, the pilot valve housing 31 may be equipped with the inserts 33, 34 which also control the flowrate of fluid proceeding through the main fluid valve assembly 10 to the outlet 18. The inserts 33, 34 may be provided in a variety of sizes and the inserts 33, 34 may be changed to fine tune the efficiency of the pump. FIG. 3 illustrates the location of the pilot valve spool 36 in the cavity 32 of the housing 31. FIG. 4 further illustrates the location of the inserts 33, 34 in the pilot valve housing 31.

Figure 5:
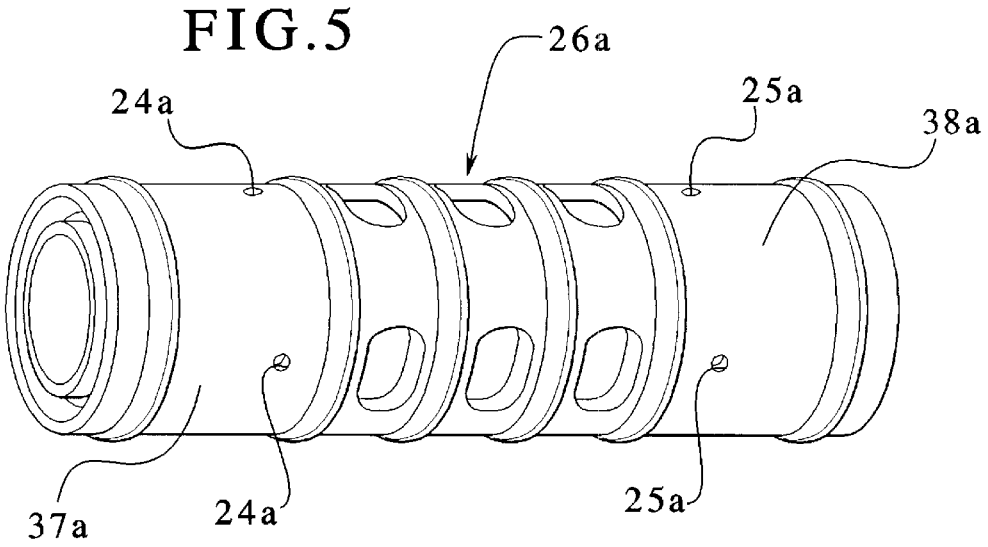
FIG. 5 is a perspective view of a sleeve assembly for a spool of a main fluid valve assembly made in accordance with the present invention.
Figure 6:
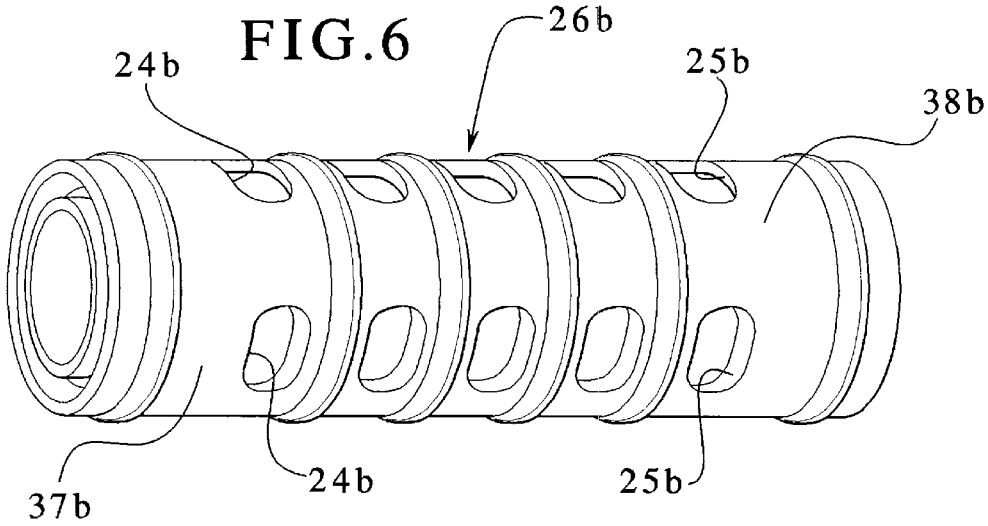
FIG. 6 is a perspective view of a sleeve assembly for a spool of a main fluid valve assembly made in accordance with the present invention.
Figure 7:
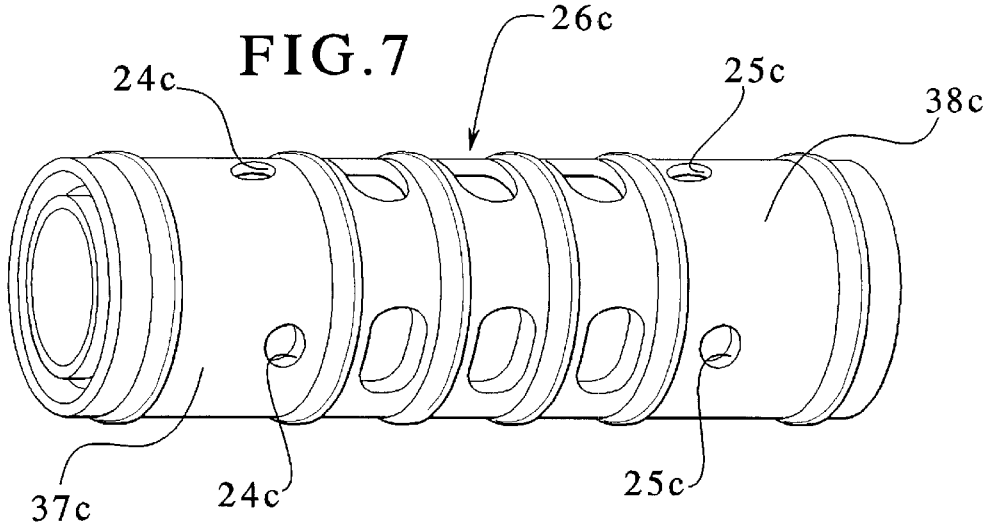
FIG. 7 is a perspective view of a sleeve assembly for a spool of a main fluid valve assembly made in accordance with the present invention.
Figure 8:
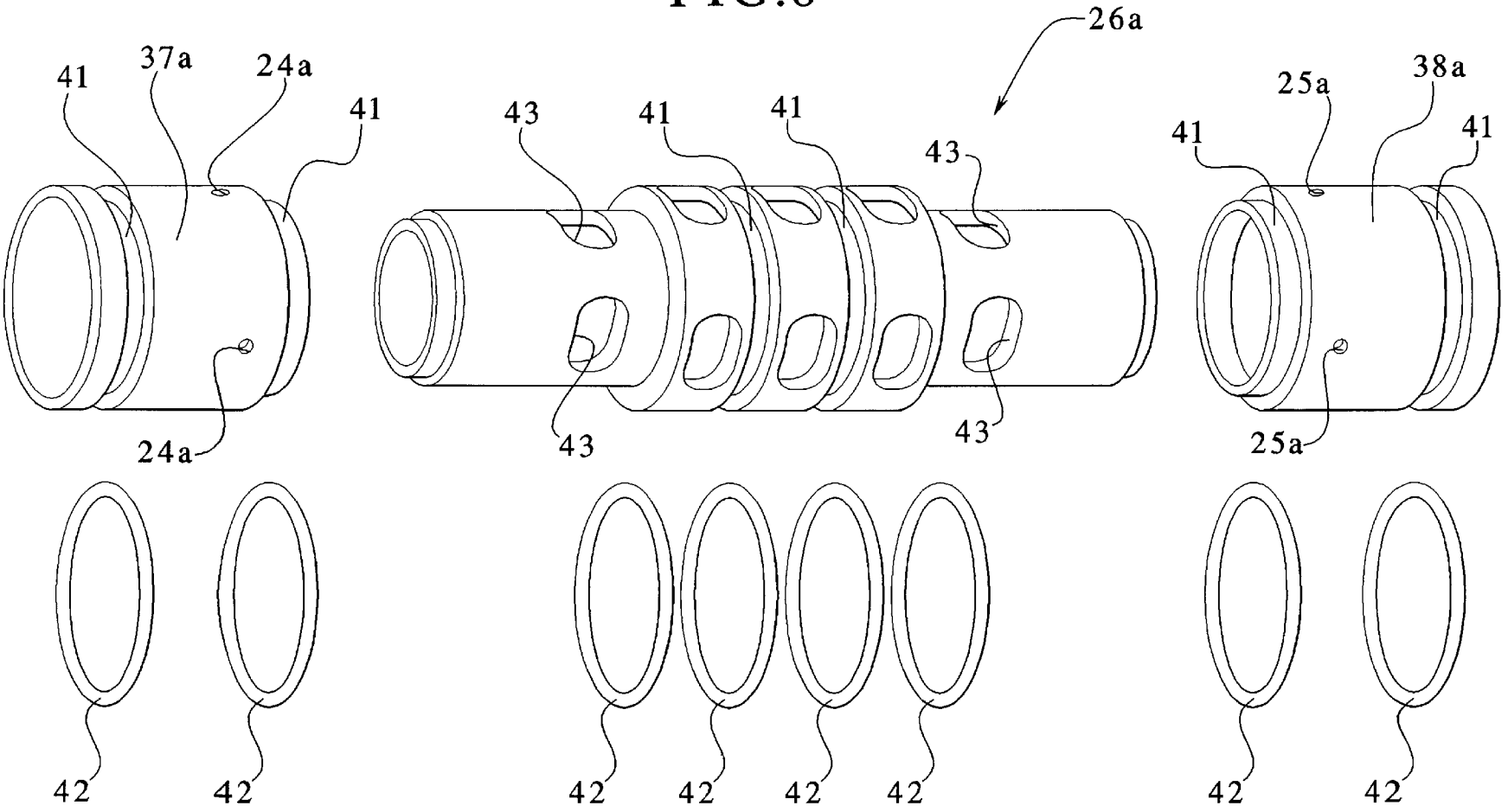
FIG. 8 is an exploded view of the spool and sleeve assembly shown in FIG. 5, particularly illustrating the attachable end sleeve portion with control orifices disposed therein.

FIGS. 5–7 illustrate the location of first and second control orifices 24*a–c*, 25*a–c* in the first and second end portions 37*a–c*, 38*a–c* of the sleeves 26*a–c*. Specifically, referring to FIG. 5, small first control orifices 24*a* and second control orifices 25*a* are disposed in the end portions 37*a,* 38*a* respectively of the sleeve 26*a*. In a preferred embodiment, as shown in FIG. 8, the end portions 37*a,* 38*a* are detachable from the main sleeve portion. Accordingly, in the event the size of the control orifices 24*a* needs to be modified, or, for example, enlarged, only the end portions 37*a,* 38*a* need to be detached from the main portion of the sleeve 26*a* and replaced with orifices of a different size, such as the orifices shown at 24*b,* 24*c* and 25*b,* 25*c* in FIGS. 6 and 7. Thus, the entire sleeve assembly 26*a* need not be replaced, only the first and second sleeve portions 37*a* and 38*a* in the event the size of the orifices 24*a,* 25*a* needs to be changed. It will also be noted that the grooves shown at 41 accommodate the O-ring shown at 42. It will also be noted that the underlying orifices shown at 43 which are disposed below the control orifices 24*a* and 25*a* can be of a standard size.

Accordingly, referring back to FIGS. 2 and 3, the sleeve 26 may be accessed relatively easily by way of the design of the main fluid valve assembly 10. Removal of the sleeve 26 enables the end portions 37*a* and 38*a* to be changed quickly and easily to change the size of the control orifices. Further, the pilot valve housing 31 is also easily accessed for replacing the inserts 33, 34. Therefore, the flowrate of fluid to the main air valve assembly 10 can be altered easily to fine tune the efficiency of the pump.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A main fluid valve assembly for a fluid powered diaphragm pump comprising:

a spool slidably accommodated in a housing, the spool being movable between a first position and a second position;

the housing comprising a first inlet, a second inlet and an outlet, the spool comprising a first peripheral groove that provides communication between the first inlet and the outlet when the spool is in the first position, the spool further comprising a second peripheral groove that provides communication between the second inlet and the outlet when the spool is in the second position, the assembly further comprising a first control orifice disposed between the first inlet and the outlet for controlling fluid flow between the first inlet and the outlet, the assembly further comprising a second control orifice disposed between the second inlet and the outlet for controlling fluid flow between the second inlet and the outlet, the first and second control orifices being detachably connected to the assembly, the spool being slidably accommodated in a first sleeve portion and a second sleeve portion, the first and second control orifices being disposed in the first and second sleeve portions respectively.

2. The main fluid valve assembly of claim 1 wherein the first sleeve portion is disposed over the first peripheral groove, the second sleeve portion is disposed over the second peripheral groove.

3. The main fluid valve assembly of claim 2 wherein the first and second sleeve portions are separate from one another and are detachably connected to the housing.

4. The main fluid valve assembly of claim 1 wherein the first and second sleeve portions are connected and are detachably connected to the housing.

5. A main fluid valve assembly for a fluid powered diaphragm pump comprising:

a spool slidably accommodated in a housing, the spool being movable between a first position and a second position, the housing comprising an inlet and an outlet, the spool comprising a first peripheral groove that provides communication between the inlet and the outlet when the spool is in a first position, the spool further comprising a second peripheral groove that provides communication between the inlet and the outlet when the spool is in the second position, the assembly further comprising a pilot valve housing connected to a first inlet passageway disposed between the inlet and the first peripheral groove and a second inlet passageway disposed between the inlet and the second peripheral groove, the assembly further comprising a first control orifice disposed in the first inlet passageway for controlling fluid flow between the inlet and the first peripheral groove, the assembly further comprising a second control orifice disposed in the second inlet passageway for controlling fluid flow between the inlet and the second peripheral groove, the first and second control orifices removably accommodating first and second inserts respectively for further restricting flow between the inlet and the first peripheral groove and between the inlet and the second peripheral groove respectively.

6. A kit for modifying a rate of fluid flow through a main fluid valve of a fluid powered diaphragm pump, the main fluid valve including a spool disposed in a housing, the spool comprising a first peripheral channel for providing communication between a first inlet and an outlet and the spool comprising a second peripheral channel for providing communication between a second inlet and the outlet, the kit comprising:

at least one sleeve for accommodating the spool, the sleeve comprising a first control orifice disposed between the first inlet and the outlet and a second control orifice disposed between the second inlet and the outlet, the sleeve being detachably connected to the housing.

7. The kit of claim 6 wherein the sleeve comprises a first sleeve portion and a second sleeve portion, the first and second control orifices being disposed in the first and second sleeve portions respectively.

8. The kit of claim 7 wherein the first and second sleeve portions are separate from one another and are detachably connected to the housing.

9. A kit for modifying a rate of fluid flow through a main fluid valve of a fluid powered diaphragm pump, the main fluid valve including a spool disposed in a housing, the spool comprising a first peripheral channel for providing communication between a first inlet and an outlet and the spool comprising a second peripheral channel for providing communication between a second inlet and the outlet, the pump further including a pilot valve housing disposed between both the first and second inlets and the spool, the pilot valve housing comprising a first aperture disposed between the first inlet and the spool and a second aperture disposed between the second inlet and the spool, the first and second apertures accommodating any one of a plurality of sized inserts, the sized inserts defining sized orifices between the first and second inlets and the spool for controlling the flowrate between the first and second inlets and the spool.

10. A method for controlling a flowrate through a main fluid valve of a fluid powered diaphragm pump, the main fluid valve including a spool disposed in a housing, the spool comprising a first peripheral channel for providing communication between a first inlet and an outlet and the spool comprising a second peripheral channel for providing communication between a second inlet and the outlet, the method comprising the following steps:

providing at least one removable sleeve comprising a first control orifice and a second control orifice, attaching the sleeve to the spool so the first control orifice is disposed over the first peripheral channel and the second control orifice is disposed over the second peripheral channel.

11. A method for controlling a flowrate through a main fluid valve of a fluid powered diaphragm pump, the main fluid valve including a spool disposed in a housing, the spool comprising a first peripheral channel for providing communication between a first inlet and an outlet and the spool comprising a second peripheral channel for providing communication between a second inlet and the outlet, the method comprising the following steps:

providing at least one removable sleeve comprising a first control orifice and a second control orifice, attaching the sleeve to the housing so that the spool is accommodated in the sleeve and first control orifice is disposed between the first peripheral groove and the outlet so the second control orifice is disposed between the second peripheral groove and the outlet.

* * * * *